United States Patent [19]

Mourier et al.

[11] Patent Number: 5,059,928

[45] Date of Patent: Oct. 22, 1991

[54] MODE TRANSFORMER FOR MICROWAVE ENERGY TRANSMISSION CIRCUIT

[75] Inventors: Georges Mourier, Le Port Marly; Aaron Bensimhon, Boulogne, both of France

[73] Assignee: Thomson CSF, Puteaux, France

[21] Appl. No.: 536,643

[22] PCT Filed: Jan. 6, 1989

[86] PCT. No.: PCT FR89/00002

§ 371 Date: Jul. 13, 1990

§ 102(e) Date: Jul. 13, 1990

[87] PCT Pub. No.: WO89/06869

PCT Pub. Date: Jul. 27, 1989

[30] Foreign Application Priority Data

Jan. 13, 1988 [FR] France ..... 88 00298

[51] Int. Cl.[5] ..... H01P 1/16

[52] U.S. Cl. ..... 333/21 R; 333/21 A

[58] Field of Search ..... 333/21 R, 21 A; 315/5

[56] References Cited

U.S. PATENT DOCUMENTS

| | | | |
|---|---|---|---|
| 2,769,145 | 10/1956 | Zaleski | 333/7 |
| 2,782,299 | 2/1957 | Whitehorn | 250/12 |
| 4,494,039 | 1/1985 | Kim | 315/4 |
| 4,704,611 | 11/1987 | Edwards et al. | 333/21 R |

FOREIGN PATENT DOCUMENTS

| | | |
|---|---|---|
| 0171149 | 2/1986 | European Pat. Off. . |
| 2163909 | 3/1986 | United Kingdom . |

OTHER PUBLICATIONS

D. R. Hamilton et al.: "Klystrons and Microwave Triodes", 1948, Mc-Graw-Hill Book Company, Inc.

Intermediate Electron Devices Meeting, 7-9, Dec. 1981, Washington, D.C. IEDM Technical Digest, IEEE (New York, US), H. R. Jory: "Gyro-Device Developments and Applications":, pp. 182-185.

*Primary Examiner*—Eugene R. Laroche
*Assistant Examiner*—Tan Xuan Dinh
*Attorney, Agent, or Firm*—Oblon, Spivak, McClelland, Maier & Neustadt

[57] ABSTRACT

The present invention is directed to a mode transformer for a microwave energy transmission circuit. This transformer is interposed between an electromagnetic wave source, operating in a predetermined frequency band, and a waveguide transmitting energy. This waveguide is excited by the electromagnetic wave source in a single chosen mode. The transformer has the shape of a conical tube whose large end is connected to the waveguide. The electromagnetic wave source is connected to the conical tube by a lateral opening. In the region of the conical tube where the excitation takes place the cross-section of the conical tube is smaller than that of the waveguide. At the center of the lateral opening, the cross-section of the conical tube is that which would be that of a waveguide of the same shape whose cut-off frequency, for the chosen mode, would be the central frequency of the working frequency band. The present invention has particular application to mode conversion in high power transmission circuits operating in the millimetric waves.

7 Claims, 2 Drawing Sheets

MODE TRANSFORMER FOR MICROWAVE ENERGY TRANSMISSION CIRCUIT

BACKGROUND OF THE INVENTION

1. Field of the Invention

The present invention relates to a mode transformer for a microwave energy transmission circuit.

2. Discussion of the Background

The technique of high power millimetric waves is now being developed due to generators and amplifiers such as gyrotrons, ubitrons, free electron lasers, etc. . .

Microwave energy is transmitted by waveguides. The cross-section of these guides have dimensions which must be chosen while complying with two contradictory restrictions:

a restriction due to the power to be transmitted;

a restriction due to the necessity of propagating the energy in a single mode if possible.

The power to be transmitted imposes dimensions which are sufficiently large to avoid a breakdown due to electrical fields which are too intense; the electrical fields in fact vary in a way which is proportional to the square root of the power and is inversely proportional to the square root of the cross-section of the guide.

The propagation of a single mode in the guide is, on the contrary, ensured when the dimensions of the guide are smaller than a well determined threshold, becoming much smaller as the frequency becomes higher. This threshold is called the cut-off threshold.

These imperatives become contradictory if it is sought to transmit a high power at a high frequency.

There is therefore an obligation to use oversized guides in which several modes can propagate and to impose a single operating mode by a means other than the reduction of the dimensions above the threshold corresponding to the frequency to be transmitted.

Furthermore, microwave energy transmission circuits are generally constituted by devices operating in different electromagnetic modes, for example a generator in mode $TE_{01}$, a transmission line in mode $TE_{02}$ and an antenna excited in mode $TE_{11}$.

In order to connect them a conversion must therefore take place from the output mode of an element to the mode of the following element.

A known solution to the problem of conversion between modes consists in using a waveguide having periodic disturbances in the geometry of the walls, in order to favour the conversion between two modes exhibiting beats having this periodicity along the guide. This solution generally leads to the use of waveguides of long length, for example having a length of several hundred wavelengths.

There is also known, by the application EP-0 171, 149, a mode conversion module using a conical tube whose large end constitutes the input for microwave energy in a first mode and whose small end constitutes the output for microwave energy in a second mode.

SUMMARY OF THE INVENTION

The present invention provides a particularly simple solution to the problem of the junction between two waveguides of different cross-section propagating different modes. It is particularly suited to the case in which one of the guides is operating in its fundamental mode and can only propagate that mode, and it proves to be entirely advantageous to impose a desired principal mode of propagation, in a guide whose dimensions allow, a priori, the propagation of several modes.

According to the invention, there is proposed a mode transformer comprising a conical tube, used in a microwave energy transmission circuit, interposed between, on the one hand, an electromagnetic wave source operating in a band of frequencies, in a first mode of propagation, and, on the other hand, a waveguide which must transmit energy in a second single mode of propagation, different from the first mode, to a circuit using electromagnetic energy, characterized in that:

the large end of the conical tube is connected to the waveguide, the electromagnetic wave source is connected to the conical tube by a lateral opening in such a way that the conical tube has a smaller cross-section than that of the waveguide, in the region in which the excitation takes place, while, at the centre of the opening, its cross-section is that which would be that of a waveguide whose cut-off frequency, for the second mode, would be the central frequency of the working frequency band.

This transformer structure can be produced with particularly reduced dimensions, while remaining compatible with the power to be transmitted.

The transformer according to the invention can be part of a travelling wave amplifier. In this case, an electron beam is introduced through the small end of the conical tube and the wave to be amplified is injected by the intermediary of the electromagnetic wave source which can, for example, be in the form of a rectangular waveguide operating in its fundamental mode and having a cross-section larger than the lateral opening.

BRIEF DESCRIPTION OF THE DRAWINGS

Other characteristics of the invention will appear on reading the following description illustrated by the appended figures in which.

DESCRIPTION OF THE PREFERRED EMBODIMENTS

Figure 1:
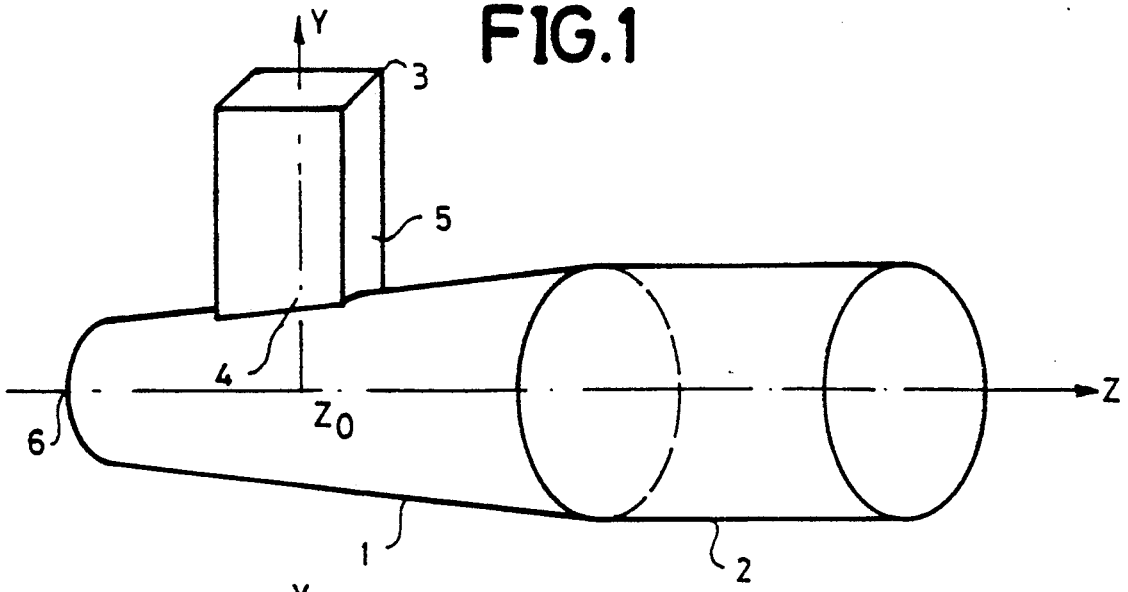
FIG. 1 shows an embodiment of a transformer according to the invention, in the case of a circular waveguide propagating towards the right the $TE_{02}$ mode.

FIG. 1 shows a transformer according to the invention in cross-section. This transformer has the shape of a conical tube 1.

The large end of this cone is connected to a waveguide 2 which transmits electromagnetic energy to a circuit using electromagnetic energy. The waveguide shown is a waveguide having a circular cross-section which propagates a single circular mode $TE_{on}$ towards the right. In this example the mode $TE_{02}$ has been chosen. The conical tube 1 is a tube of circular cross-section. The small end 6 of the conical tube can be open as shown in the figure.

An electromagnetic wave source 3 is connected to the conical tube 1 by a lateral opening 4 situated in the central section of the conical tube. This electromagnetic waves source 3 is for example constituted by a microwave tube followed by an excitation waveguide 5. The microwave tube is not shown.

The axis y of the waveguide 5 is essentially perpendicular to the axis z of the waveguide 2.

This electromagnetic wave source 3 is intended to excite the waveguide 2 about the operating frequency $f_0$.

The functioning of the transformer is as follows: for a given excitation, it is sought that the waveguide 2 should transmit only a single mode, the one which is chosen and which is different from the mode of propagation of the excitation waveguide 5.

In a waveguide of given cross-section, at a given operating frequency, there are several possible modes of propagation. For each mode there is a cut-off frequency.

At this frequency the guide behaves like a resonant cavity and the energy does not propagate. In order for propagation of energy to take place it is therefore necessary to work, for a given mode, at a slightly higher frequency or to increase the diameter of the guide. With a guide of conical shape, a concentration of electromagnetic energy is obtained while allowing the propagation of a portion of this energy towards its large end, i.e. in the direction in which the diameter of the conical tube 1 increases.

In the central region of the lateral opening 4, in a zone of the conical tube 1 having an abscissa of $z_0$, it is imposed that the central frequency $f_0$ of the working frequency band is the cut-off frequency of the mode which is chosen and which will propagate in the waveguide 2.

For this it suffices to choose appropriately the dimensions of the cross-section of the conical tube, in this region of abscissa $z_0$. These dimensions are called the cut-off dimensions. In fact, a relationship exists, for a given mode of propagation, between the dimensions of the guide and the cut-off frequency.

By way of example, in a waveguide of circular cross-section for the mode $TE_{02}$, this relationship is:

$$2\pi f_c a_o/c = 7.0156$$

where c is the speed of light $a_o$ is the radius of the guide $f_c$ is the cut-off frequency.

If the central frequency of the working frequency band is 30 GHz, a cut-off diameter of 2.233 centimeters will be obtained at $z_o$. The opening 4, which connects the guide 5 to the conical tube 1, will therefore be placed at the position where the diameter of the conical tube has this value.

If this region is excited about the frequency $f_o$, by means of the electromagnetic wave source 3, this region will behave essentially like a resonant cavity in which energy practically does not propagate but where the electrical fields are very intense. The coupling with the adjacent regions will be strong and the mode of propagation which will preferentially develop will be the mode for which the cut-off frequency is $f_o$ (the $TE_{02}$ mode in the chosen example). It will however be necessary for the electrical field in the excitation guide 5 to have components which are compatible with those of the electrical field of the mode propagating in the circular guide 2.

The waveguide 5 exciting the conical tube will preferably be a waveguide having a rectangular cross-section propagating the $TE_{01}$ mode about the frequency $f_o$. This is the fundamental mode for guides having a rectangular cross-section. This means that it is the mode for which the cut-off frequency is the lowest. This mode of propagation is unique, i.e. this guide can only propagate this mode, at the frequency $f_o$.

The $TE_{01}$ mode of propagation in the waveguide 5 of rectangular cross-section allows the excitation of a $TE_{on}$ mode in the circular guide. In fact, in the rectangular waveguide propagating the $TE_{01}$ mode, the electrical field lines are parallel to the small side of the guide. In a circular waveguide, propagating a $TE_{on}$ mode, the electrical field lines are circular and are situated in planes perpendicular to the longitudinal axis.

At the junction 4, the large sides of the waveguide 5 of rectangular cross-section being parallel to the axis z of the circular waveguide 2, the components of the electrical field in the rectangular waveguide correspond well to those of the electrical field in the circular waveguide 2 propagating a $TE_{on}$ mode.

It is preferred not to use a circular or square guide as the excitation guide because even in the fundamental mode it is possible to obtain two operating modes depending on the orientation of the electrical field lines.

The energy transmitted by the electromagnetic wave source 3, is propagated essentially towards the transmission waveguide 2, i.e. in the direction in which the diameter of the conical tube 1 increases. There will be practically no transmission towards the other end 6 of the conical tube 1, because its diameter becomes smaller than the cut-off diameter. Its diameter is too small to propagate the excited mode $TE_{02}$ at frequencies near $f_o$.

If the region of abscissa $z_o$ of the conical tube 1 is excited at a frequency $f_1$ close to $f_o$, the region of maximum energy accumulation will no longer have the abscissa $z_o$ but an abscissa $z_1$. This abscissa $z_1$ will be slightly shifted towards the transmission waveguide 2 if $f_1$ is lower than $f_o$.

Figure 2A:
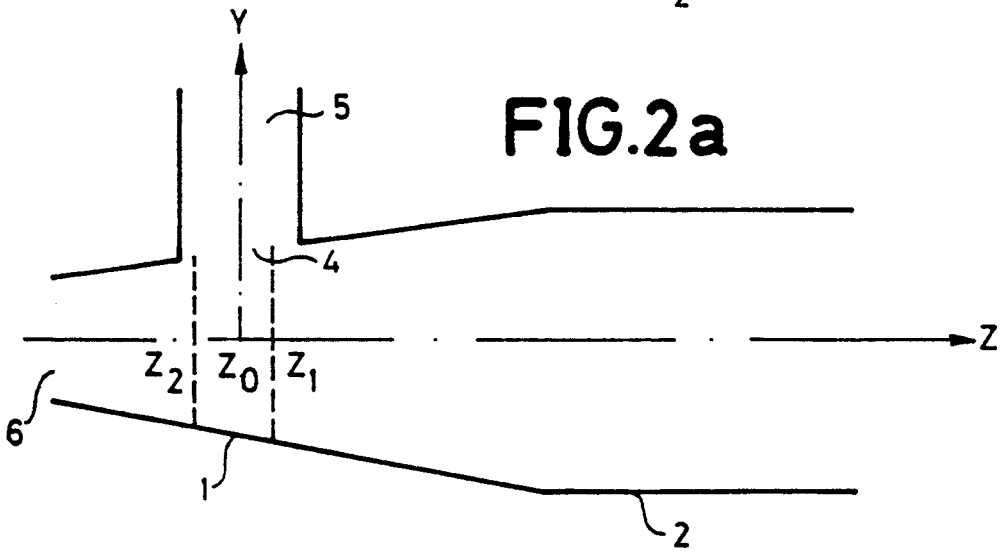
FIG. 2*a* shows a cross-section of the transformer in which the abscissas of the zones of maximum energy accumulation when the excitation frequency varies are indicated.

On the contrary, if the region of abscissa $z_o$ of the conical tube 1 is excited at a frequency $f_2$ higher than $f_o$, the region of maximum energy accumulation will have an abscissa $z_2$ slightly shifted towards the end 6 of the conical tube 1 having a smaller cross-section. These variants are shown in FIG. 2*a*. Coupling remains possible as long as the abscissa of the region of maximum energy accumulation is still within the mouth 4 of the excitation waveguide 5 of rectangular cross-section. The dimensions of the excitation waveguide 5 of rectangular cross-section are however limited.

The greater the angle of the conical tube 1 becomes, the more the coupling frequency band increases, but the more the coupling intensity reduces because the conical tube 1 is already propagating energy in regions of abscissa very close to $z_o$ but shifted towards the waveguide 2 and the stored electromagnetic energy reduces.

Figure 2B:
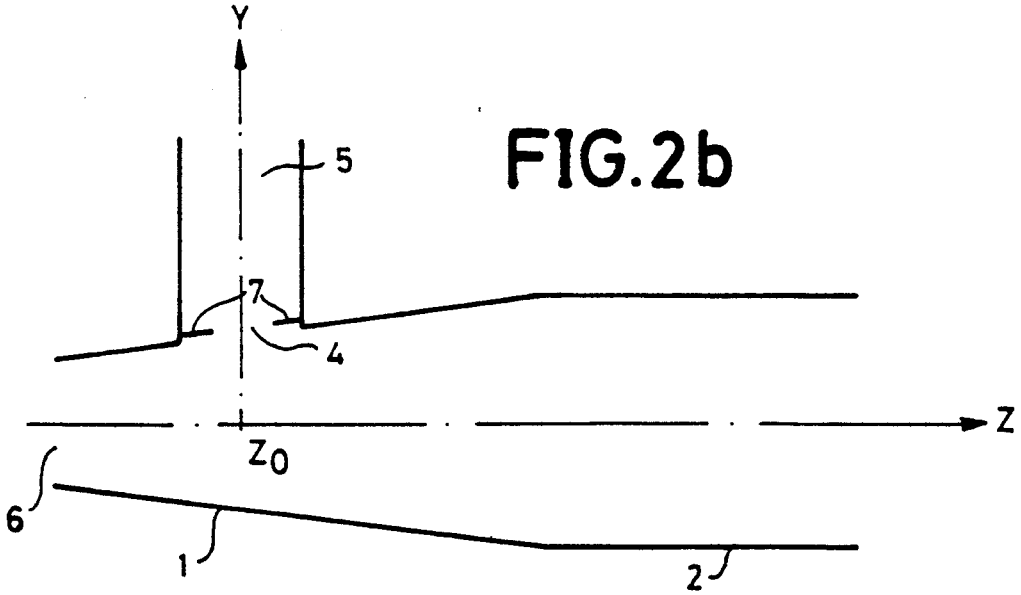
FIG. 2*b* shows a cross-section of the transformer in which the junction between the conical tube and the electromagnetic waves source is perfectly matched, by means of shutters.

In order to obtain perfect matching between one mode and another, one can be led to adjust the dimensions of the excitation waveguide 5 at the junction. For this purpose it is possible to add shutters 7 at the output of the excitation waveguide 5 at the junction with the conical tube 1 in order to reduce the dimensions of the opening 4. This variant is shown in FIG. 2*b*.

Figure 3A:
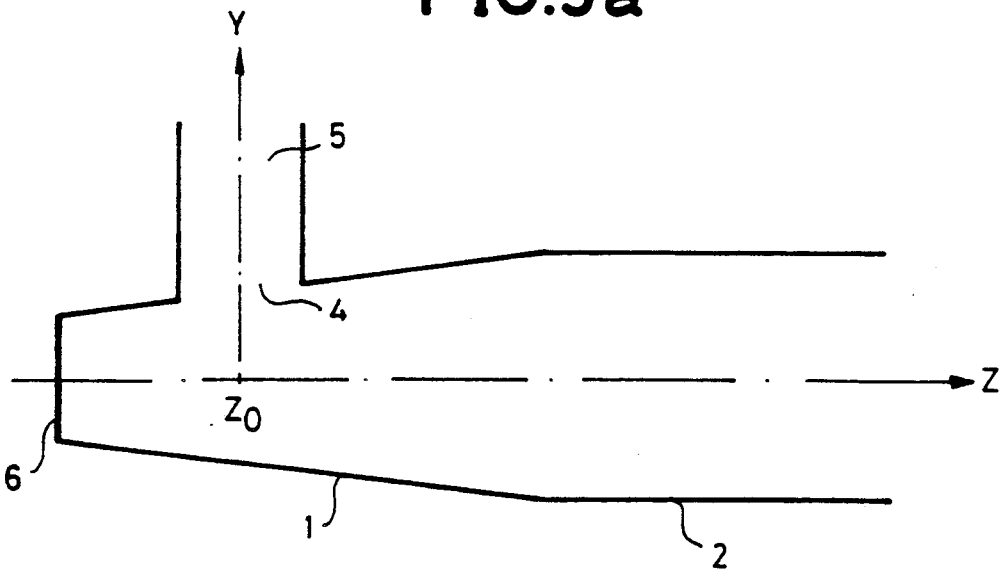
FIG. 3*a* shows a variant embodiment of the transformer, in which the small end of the conical tube is closed.

The invention is capable of having variants according, in particular, to the nature of the circuit which terminates the conical tube at its small end 6. This small end 6 can be short-circuited, i.e. closed as shown in FIG. 3*a*.

Figure 3B:
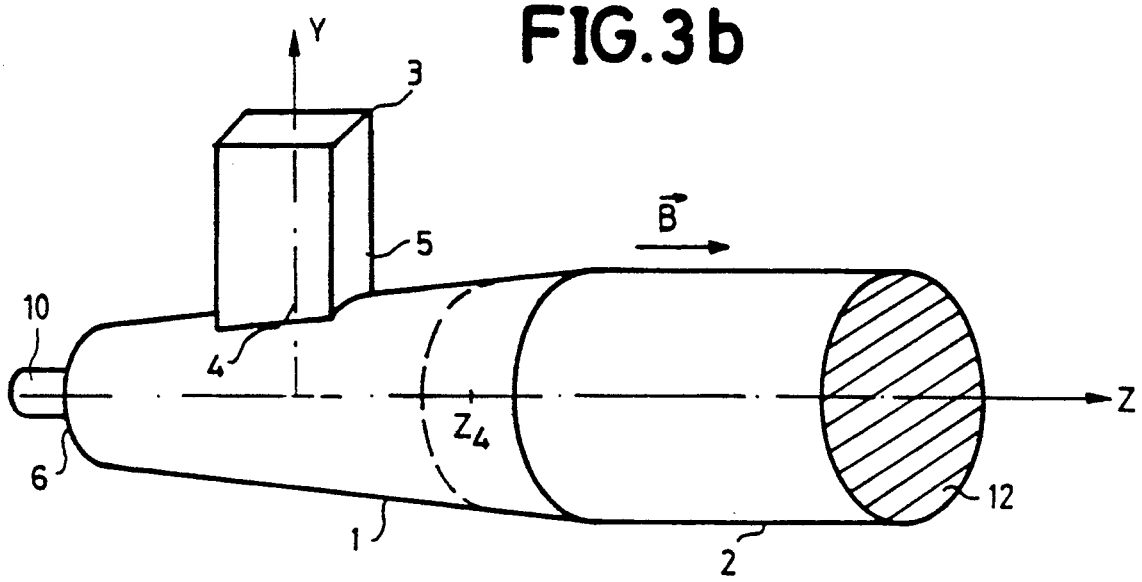
FIG. 3*b* shows an application of the invention to a travelling wave amplifier. In these figures the same references denote the same elements. The proportions of the various elements have not been complied with for the purpose or clarity.

A particularly advantageous variant is shown in FIG. 3*b*.

It is a matter of using this mode transformer at the input of an amplifier of the travelling wave gyrotron type for example.

An electron gun 10, producing an axial electron beam, is placed at the end 6 of the conical tube having the small diameter.

The electromagnetic wave to be amplified is introduced by the intermediary of the excitation guide 5. It is amplified along the waveguide 2 and is sent into a waveguide, not shown, ending at an antenna for example. In this case, the waveguide 2 is terminated by a window 12 made from aluminum for example. A magnetic field is created by coils, which are not shown, along the axis z.

In this case parasitic oscillations which can occur at a frequency between the frequency $f_o$ and the cut-off frequency of the transmission guide 2 are to be feared. The frequency of the transmission guide 2 is lower than $f_o$.

For a frequency within this frequency range, the diameter of the conical tube 1 which corresponds to the cut-off will be positioned at an abscissa $z_4$ between $z_o$ and the input of the waveguide 2 of circular cross-section. If the interior of the conical tube 1 is lined with absorbent material in the region adjacent to the input of the waveguide 2 of circular cross-section, these parasitic frequencies will be dampened selectively. One can also be led to use a solid material, absorbing the waves of a frequency substantially higher than $f_o$ which would come from the excitation waveguide 5. This absorbent material will line the interior of the conical tube 1 in a region included between the lateral opening 4 and the end 6 of the conical tube.

If the transmission waveguide 2 is of rectangular cross-section, the mode transformer according to the invention will, without disadvantage, be constituted by a conical tube of rectangular cross-section.

The dimensions of the cross-section of the mode transformer, at the cut-off, will be able to be calculated such that at this place in the cone, in the chosen mode, the working frequency is the cut-off frequency.

By way of example, the following are the dimensions of a conical tube transforming the rectangular $TE_{01}$ mode into the circular $TE_{02}$ mode and giving very good results.

This conical tube has a circular cross-section, its small diameter is 13 mm
its large diameter is 30 mm
and its length is 60 cm.

We claim:

1. Mode transformer for a microwave energy transmission circuit, comprising:

a conical tube, interposed between an electromagnetic wave source operating in a predetermined frequency band and transmitting energy in a first propagation mode, and a waveguide transmitting energy in a second unique propagation mode, the second propagation mode being different from the first propagation mode; wherein, a large end of said conical tube is connected to the waveguide;

said electromagnetic wave source is connected to said conical tube via a lateral opening and excites a region of said conical tube where the conical tube has a cross section smaller than that of the waveguide; and at a center of the lateral opening, dimensions of the cross section of the conical tube are cut-off dimensions for the second unique propagation mode at a central frequency of the operating band frequency.

2. Mode transformer according to claim 1, wherein said electromagnetic wave source comprises a microwave tube and a rectangular waveguide, the rectangular waveguide being connected between the microwave tube and the conical tube, the rectangular waveguide functioning in its fundamental propagation mode, said fundamental mode having field lines compatible with the second propagation mode.

3. Mode transformer according to claim 2, wherein the cross section of said excitation waveguide is reduced by shutters in order to match coupling of the connection with the conical tube.

4. Mode transformer according to claim 1, wherein the small end of the conical tube is open.

5. Mode transformer according to claim 1, wherein the small end of the conical tube is short-circuited.

6. Mode transformer according to claim 2, wherein said mode transformer is a part of a travelling wave amplifier, the wave to be amplified being injected by the waveguide and an electron gun producing an axial electron beam, said electron gun being placed at the small end of the conical tube.

7. Mode transformer according to claim 1, wherein an interior of the conical tube is lined with absorbent material in the regions situated on either side of the lateral opening in order to dampen parasitic oscillations occurring at frequencies close to the central frequency of the operating band.

* * * * *